United States Patent [19]

Sato

[11] 4,025,244

[45] May 24, 1977

[54] ROTARY COMPRESSOR OF LIQUID-COOLED TYPE PROVIDED WITH MEANS FOR ADJUSTING AMOUNT OF LIQUID AND VOLUME OF GAS

[75] Inventor: Goro Sato, Atami, Japan

[73] Assignee: Hokuetsu Kogyo Co., Ltd., Japan

[22] Filed: Sept. 4, 1975

[21] Appl. No.: 610,273

[30] Foreign Application Priority Data

Dec. 24, 1974 Japan ..... 49-147673

[52] U.S. Cl. ..... 418/87; 418/97

[51] Int. Cl.[2] ..... F04C 29/02

[58] Field of Search ..... 418/84, 87, 99, 201, 418/97; 417/228

[56] References Cited

UNITED STATES PATENTS

| | | | |
|---|---|---|---|
| 2,961,151 | 11/1960 | Fobian | 418/88 X |
| 3,432,089 | 3/1969 | Schibbye | 418/88 |
| 3,482,768 | 12/1969 | Cirrincione et al. | 417/228 |
| 3,874,828 | 4/1975 | Herschler et al. | 418/87 |
| 3,936,249 | 2/1976 | Sato | 418/99 X |

FOREIGN PATENTS OR APPLICATIONS

| | | | |
|---|---|---|---|
| 1,237,333 | 6/1971 | United Kingdom | 418/97 |

*Primary Examiner*—Carlton R. Croyle
*Assistant Examiner*—Leonard Smith

[57] ABSTRACT

A rotary compressor of the liquid-cooled type including means for injecting a cooling, lubricating and sealing liquid into gas compression chambers, means for adjusting the volume of gas compressed by shifting the sucking and shutting position in said compression chambers and means for adjusting the amount of the liquid to be injected into said compression chambers in conformity with the adjustment made by said gas volume adjusting means, said liquid amount-adjusting means being interlocked with said gas volume adjusting means.

4 Claims, 8 Drawing Figures

ROTARY COMPRESSOR OF LIQUID-COOLED TYPE PROVIDED WITH MEANS FOR ADJUSTING AMOUNT OF LIQUID AND VOLUME OF GAS

This invention relates to a rotary compressor of the liquid-cooled type.

The quantity of the compression heat generated when a gas is compressed varies depending on the kind of the gas, the compression ratio and the volume of the gas. In partial load operation or non-load operation of the compressor, since the volume of gas to be compressed is smaller than in full load operation, the quantity of compression heat generated should naturally be smaller. Accordingly, when a compressor of the liquid-cooled type is operated under a partial load or no load, the amount of the cooling liquid to be injected into the compression chambers may be reduced as compared with the case of full load operation.

In the rotary compressor of the liquid-cooled type comprising means for cooling the gas and machine by injecting a liquid into the compression chambers for attaining cooling, lubricating and sealing effects, if the amount of the liquid injected is excessive additional power is consumed for agitating the excess of the liquid, and since the amount of the liquid in the liquid-gas mixture increases, noise is generated and the machine is damaged because of lack of the buffering action of the gas. Further, since the gas is excessively cooled and water contained in the gas is excessively condensed, deterioration of the injected liquid is caused by the condensed water, resulting in reduction of the cooling and lubricating effect, and machine is adversely affected. Accordingly, water incorporated into the liquid must be removed by provision of an additional device or means, resulting in additional consumption of power, and various losses are brought about.

In order to overcome disadvantages brought about by the excessive liquid, it is necessary to attach to a compressor of the liquid-cooled type a liquid amount-adjusting means capable of continuously adjusting the amount of the liquid to be injected into the compression chambers in conformity with changes in the volume of a compressed gas sucked by the compressor. By provision of such adjusting means, power can be saved and the durability of the machine can be increased, and further, it is made possible to prevent deterioration of the liquid having the cooling, lubricating and sealing activities and to reduce the frequency at which the liquid must be changed.

It is therefore a primary object of this invention to provide means to be attached to a rotary compressor of the liqid-cooled type, in which adjustment of the volume of sucked gas is performed by shifting the sucking and shutting position at the compression chambers, and at the same time and in the same unit, adjustment of the amount of cooling, lubricating and sealing liquid injected into the compression chambers is performed in conformity with the shifting of the sucking and shutting position, whereby the machine structure can be simplified, cost is lowered, troubles in the compressor can be effectively prevented and an ideal operation state can always be maintained.

A secondary object of this invention is to provide means to be attached to a rotary compressor of the liquid-cooled type, in which the ratio between the volume of sucked gas and the amount of cooling, lubricating and sealing liquid can always be maintained within a practical optimum range.

Optimum values of this ratio vary depending on the kind of the machine, the kind and temperature of the gas, the kind and temperature of the liquid, the ambient temperature and other factors. Supposing that as a lubricating oil a kind of turbine oil now used widely in this field is used as the cooling, lubricating and sealing liquid, and that air or a refrigerant gas is used as the gas to be compressed, then the upper and lower limits of the above ratio applicable under normal ambient conditions can be determined by experiments.

As mentioned above, the amount of the liquid to be fed into the compression chambers is adjusted in conformity with the volume of the sucked gas, but even when the volume of the gas is zero, namely in non-load operation, the liquid should be injected into the compression chambers in a minimum volume necessary for lubrication of the compressor. When such liquid accumulates in a discharge chamber of the compressor, it often happens that noises are generated or the machine is damaged by oil-locking due to the presence of the accumulated liquid. Further, because of stagnation of such liquid a back pressure is imposed on the rotors of the compressors and additional power is wastefully consumed. Therefore, accumulation of the liquid in the discharge chamber should be avoided as much as possible.

It is a third object of this invention to provide means to be attached to a rotary compressor of the liquid-cooled type provided with the above-mentioned adjusting means, in which a liquid separated from compressed gas in a discharge chamber is always recovered during operation and introduced into a liquid tank from a liquid take-out opening provided at the bottom of the discharge chamber of the compressor by means of a pump exclusive for removal of the liquid, whereby accumulation of the liquid in the discharge chamber is prevented to thereby save the operating power and prevent damage to the machine and generation of noise.

Embodiments of this invention, that by no means limit the scope of this invention, will now be described with reference to the accompanying drawing, in which.

Figure 1:
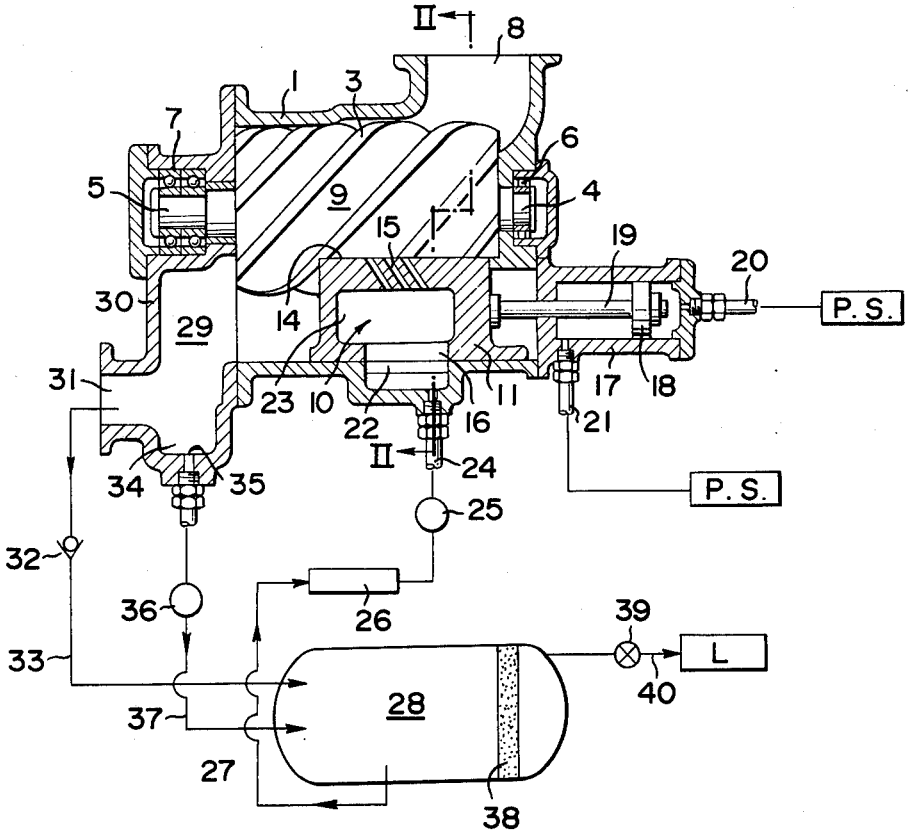
FIG. 1 is a longitudinally sectional view illustrating the first embodiment of this invention.
Figure 2:
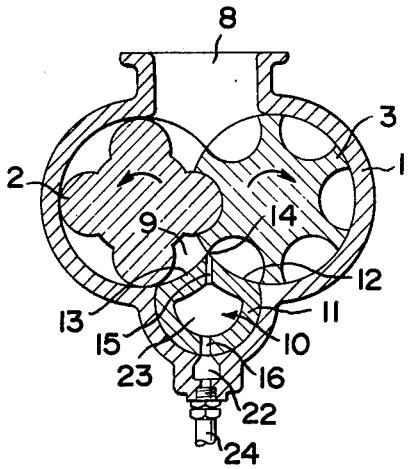
FIG. 2 is a view illustrating a section of the first embodiment taken along the line II—II in FIG. 1.

Referring to FIGS. 1 and 2, a male rotor 2 and a female rotor 3 are contained in a main part 1 of a compressor casing, and the two rotors are engaged with each other and their end shafts 4 and 5 are rotatably supported by bearings 6 and 7, respectively. The shaft 4 of the male rotor 2 is driven by a motor (not shown).

A suction chamber 8 is formed in the upper portion of the main part 1 of the casing at one end thereof, and in the main part 1 compression chambers 9 are formed under the male and female rotors 2 and 3. On the side for shutting the suction of the gas into the compression chambers 9 formed under the male and female rotors 2 and 3, an adjusting valve 10 is disposed in the main part 1 so that it can slide in the axial direction of the rotors. This adjusting valve 10 comprises a main body 11 having on the upper side two cylindrical faces 12 and 13 having the same curvature as that of the inner bore of the main part 1 defined by the rotation of the two rotors 2 and 3. A projecting edge 14 is formed at the intersection of the cylindrical faces 12 and 13, and an opening 15 for injecting the cooling, lubricating and sealing liquid is disposed on this projecting edge 14. Accordingly, the main body 11 of the adjusting valve 10 constitutes a part of the casing 1.

A slot 16 is disposed in the lower portion of the main body 11, and one end of the main body 11 is connected to a rod 19 of a piston 18 in an operating cylinder 17 attached to one end of the casing 1.

At opposite ends of the cylinder 17, there are provided fluid-inlets 20 and 21, which are connected to a source of power in the form of liquid or gas under pressure, P.S., and the liquid or gas is introduced into the cylinder so as to control the position of piston 18.

A slot 22 is disposed at the lower portion of the main part 1. This slot 22 is connected, on the one hand, to an injection opening 15 through the slot 16 in the main body 11 of the adjusting valve and a hollow portion 23 of the main body 11, and is connected, on the other hand, to the bottom of a compressed gas and liquid tank 28 through an inlet 24 for introduction of a cooling, lubricating and sealing liquid, a pump 25 and a cooler 26 by means of a pipe 27.

The other end of the main part 1 of the casing is connected to another part 30 of the casing in which a discharge chamber 29 connected to the compression chambers 9 is formed, and this part 30 has on the outer side face thereof an opening 31 for discharge of compressed gas. The discharge opening 31 is connected to the compressed gas and liquid tank 28 through a non-return valve 21 by means of a pipe 33.

The part 30 has a liquid reservoir 34 in the lower portion thereof, and this liquid reservoir 34 is connected to the compressed gas and liquid tank 28 through a liquid take-out opening 35 and a recovery pump 36 by means of a pipe 37.

The discharge chamber 29 within the part 30 has suitable shape and sufficient volume to separate the liquid from the gas. The liquid reservoir 34 is provided at a lower level than the gas discharge opening 31, and the liquid take-out opening 35 is positioned at the lowest point in the liquid reservoir 34.

A separator 38 is mounted in the interior of the compressed gas and liquid tank 28, and one end of the tank 28 is connected to the working site or load L through a valve 39 by means of a pipe 40.

The mixture of compressed gas and liquid discharged from the compression chambers 9 is separated into gas and liquid in the discharge chamber 29, and the majority of the liquid is collected in the liquid reservoir 34 and is always introduced into the compressed gas and liquid tank 28 through the liquid take-out opening 35 by means of a recover pump 36. All of the gas and a very small part of the liquid are discharged into the compressed gas and liquid tank 28 from the discharge opening 31 through the no-return valve 32.

According to changes in the gas flow rate, the temperature or pressure in the compressed gas and liquid tank, the liquid or gas under pressure is introduced from the introduction inlet 20 or 21 to move the piston 18 to the right or left in the drawings, and the adjusting valve 10 is moved to the right or left through the rod 19, whereby the sucking and shutting position in the compression chambers 9 defined by the male and female rotors 2 and 3 and the casing 1 is shifted to change the volume of the gas compressed.

The cooling, lubricating and sealing liquid is fed from the compressed gas and the liquid tank 28 to the inlet 24 of the part 1 of the casing through the pipe 27 and the cooler 26 by means of the pump 25.

The compressed gas is separated from the liquid by a separator 38 mounted in the tank 28 and the gas alone is discharged to the outside through a valve 39 and sent to the working site.

FIG. 1 illustrates the compressor in the state of full load compression operation. In FIG. 1, the adjusting valve 10 is located at the right most position and the whole of the compression chambers 9 is closed up. As the value 10 is shifted toward the left, the shutting position is changed in the compression chambers 9 and the effective volume of the compression chambers 9 is reduced.

As pointed out above, the adjusting valve 10 in FIG. 1 is shown in the position for the full load operation. In this case, the slot 22 of the casing and the slot 16 of the valve are overlapped with each other along the entire length and are fully connected to each other. Accordingly, the total amount of liquid fed from the tank 28 is injected into the compression chambers 9 from the injection opening 16 through the hollow portion 23. The slots 22 and 16 have generally the same width. In the slots 22 and 16, the width can be uniform through the entire length, but in practice, since the length of travel of the adjusting valve 10 is not exactly in proportion to the volume of the sucked gas, the width of each slot may vary in the longitudinal direction so that the amount of liquid is always optimum for the volume of the sucked gas. Further, the openings of the slot 22 and 16 are formed as to allow the liquid to pass through in the minimum amount necessary for lubrication of the rotors, casing and bearings even in non-load operation, namely even when the valve 10 is at the left most position in FIG. 1. At any rate, the shapes and dimensions of the slots 22 and 16 should have such relation that they give an area of passage for the liquid always meeting the requirement which will be described later.

When the volume of the sucked gas is changed in conformity with changes in the pressure, flow rate or temperature of the compressed gas, by the change in the hydraulic or gas pressure introduced from the inlet 20 or 21, the piston 18 is moved to the left in FIG. 1 and the adjusting valve 10 connected to the piston 18 through the rod 19 is also moved to the left to reduce the volume of the sucked gas. When the adjusting valve 10 is thus moved, the area of the passage for liquid through the slots 22 and 16 is reduced and the amount of the liquid fed is decreased. Thus, the cooling, lubricating and sealing liquid is always injected in the compression chambers 9 in an optimum amount in conformity with the volume of the sucked gas.

In this case, these slots 16 and 22 and the adjusting valve 10 should be designed so that the change in the amount of the injected liquid which is caused by the change in passage area defined by the slots 22 and 16, and the change of the volume of the sucked gas which is controlled by the adjusting valve 10, will always satisfy the requirement represented by the formula given below.

In the case of a rotary screw compressor of the single-stage compression type, it has been confirmed by experiments that, when turbine oil is used as the lubricating liquid for cooling, lubricating and sealing, and when air or refrigerant gas is to be compressed, the weight of the injected liquid should be about 4 to 10 times the weight of the compressed gas in the full load operation. If this proportion is not maintained, the injected liquid fails to perform sufficient cooling, lubricating and sealing activities in the compression chambers, or disadvantages such as mentioned above are brought about. More specifically, it has been confirmed by experiments that the ratio of the amount of the injected liquid to the volume of the sucked and compressed gas, which does not cause any of the disadvantages but allows the liquid to exhibit sufficient cooling, lubricating and sealing effects, is within a certain range and that the upper limit of the amount L of the cooling, lubricating and sealing liquid injected into the compression chambers is represented by the following empirical formula:

$$L = 103 - 330 /(G + 10)$$

and the lower limit is represented by the following empirical formula:

$$L = (4/5)\ G = 20$$

In the above empirical formulae, $G$ stands for the relative value of the volume of the sucked gas determined based on the supposition that the volume of the gas sucked in the full load operation is 100, and $L$ stands for the relative value of the amount of the injected liquid determined based on the supposition that the amount of the liquid injected in the full load operation is 100.

The compression coefficient of compressed gas used in this case is about 1.3 For example, air has a compression coefficient of about 1.4 and refrigerant gas has a compression coefficient of about 1.3. Liquid having a specific heat of about 0.5 to 1.0° Kcal/kg C. is usually used as the liquid to be injected.

Figure 8:
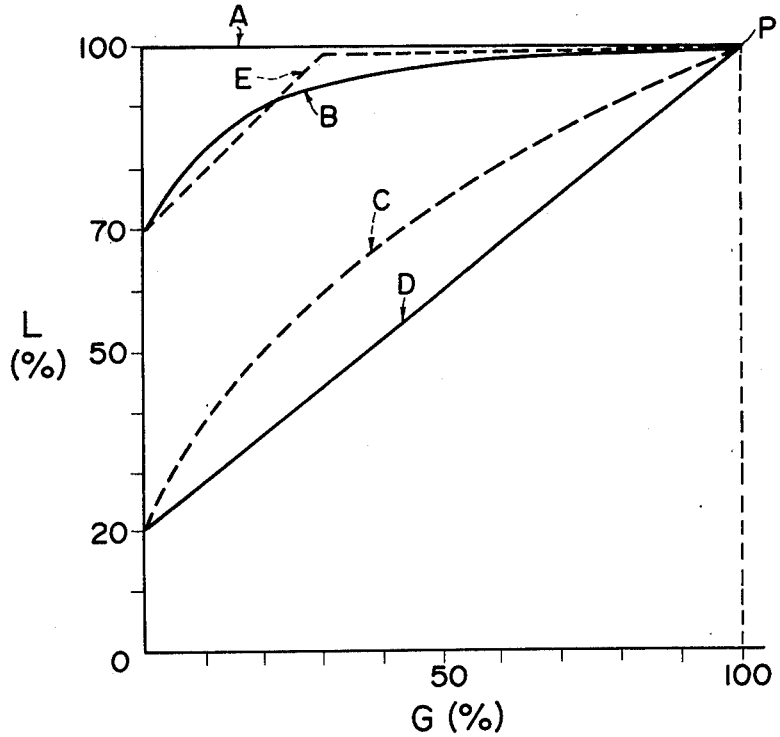
FIG. 8 is a graph illustrating the relation between the volume of the sucked gas and the amount of the liquid injected.

The graph of FIG. 8 shows the above-mentioned preferable range of the ratio of the amount of the cooling, lubricating and sealing liquid to the volume of the sucked and compressed gas. The ordinate indicates the amount of the liquid injected and is equally graduated from 0 to 100 (the amount of the liquid injected in full load operation) to show the amount L (%) of the liquid injected. The abscissa inidicates the volume of the sucked and compressed gas and is equally graduated from 100 (the volume of the sucked and compressed gas in full load operation) to 0 (the volume of the gas in the non-load operation, namely zero) to show the volume G (%) of the sucked and compressed gas. In the graph of FIG. 8, the point P is a basic point in which the volume G of the sucked and compressed gas is 100 (the volume of the gas sucked in full load operation) and the amount L of the injected liquid is 100 (the amount of the injected liquid optimum for full load operation). The line A indicates the case where the amount of the injected liquid is not at all adjusted. In this case, the defects and disadvantages mentioned in the beginning portion of the instant specification are brought about unless the compressor is in the full load operation. The curve B indicates the allowable upper limit of the amount of the injected liquid and is represented by the following empirical formula:

$$L = 103 - 330 /(G + 10)$$

The lower limit of the amount of the liquid injected is empirically shown as the curve C, but in practice, the intended objects of this invention can be attained even when the lower limit is indicated by an approximate line D connecting the basic point P to the point where the volume of the sucked gas is 0% (in non-load operation) and the amount of the injected liquid is 20% (the minimum amount necessary in non-load operation). This approximate line D for the allowable lower limit of the amount of the liquid is represented by the following formula:

$$L = 4/5\ G + 20$$

As is apparent from FIG. 8, even in the case of total non-load operation, namely even when the volume of the sucked gas is zero, the liquid is injected in an amount corresponding to 20 to 70% of the amount of the liquid injected in full load operation only for lubrication of the inside of the compressor. Also from this FIG. 8, it will readily be understood that when the volume of the sucked gas is, for example, 80%, the amount of the liquid injected is limited within a range of 99.3 to 84% of the amount of the liquid injected in full load operation.

For the adjustment of the amount of the liquid, it is possible to adopt a method shown by a broken line E in FIG. 8. Namely, it is possible to adopt a rough adjustment method in which no adjustment is conducted until the value of G comes down to a certain level, for example, about 30%, and if the value of G descends below this level, the amount of the liquid is adjusted so that it becomes minimum, for example 70%, when G is zero. In this method, since the adjustment is rather rough, the disadvantages mentioned before cannot be completely prevented, but it can be said that this method is principally included in the scope of the technical concept of the adjustment method of this invention.

As is apparent from the foregoing description, in the apparatus of this invention, the shapes and dimensions of the slots 22 and 16 are designed so as to give an adequate area of passage for the amount of liquid L, which is forced by the pump 25 of a suitable capacity. The amount L is adjusted according to the change of G, which is controlled by the adjusting valve 10, in a manner to satisfy the following formula $$103 - (330 /G + 10) \geqq L \geqq (4/5)\ G + 20$$

In this way, the volume of sucked gas can be automatically adjusted to maintain an ideal relation between the gas volume G and liquid amount L without any other particular operation to adjust the amount of liquid. Further the relation is determined by a single device and therefore is not subject to outside influence after it has been determined.

One of the features of this invention is that any continuous curve within the allowable area in FIG. 8 is obtainable by choosing the proper shape and relation between the slots 22 and 16, and using a pump of proper capacity.

Even in the case of a rotary compressor of the liquid-cooled type provided with the above-mentioned adjusting means, the amount of liquid fed into the compression chambers in non-load operation is 20 to 70% of the amount of the liquid injected in full load operation, which is necessary for the lubrication of the compressor. If such liquid remains in the discharge chamber, the proportion of the liquid to the gas increases and shock cannot be absorbed, causing oil-locking and undesirable noise, and the machine may be damaged. Further, in such case, a back pressure is imposed on the rotors and additional power is wasted in non-load operation.

The discharge chamber 29 is so designed that the liquid is separated from a mixture of compressed gas and liquid discharged from the compression chambers 9, and is collected in the liquid reservoir 34 formed at the bottom of the discharge chamber 29 as much as possible. The liquid collected in this reservoir 34 is discharged from the discharge chamber 29 so as to prevent the pressure rise in the discharge chamber.

For the above purpose, the liquid take-out opening 35 is provided in the liquid reservoir 34 and the separated liquid is always recovered by the pump 36 as described hereinabove.

Figure 4:
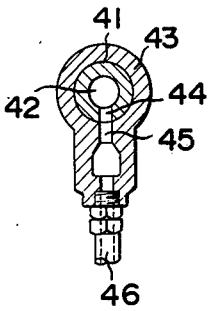
FIG. 4 is an enlarged view illustrating a section of the second embodiment taken along the line IV—IV in FIG. 3.
Figure 3:
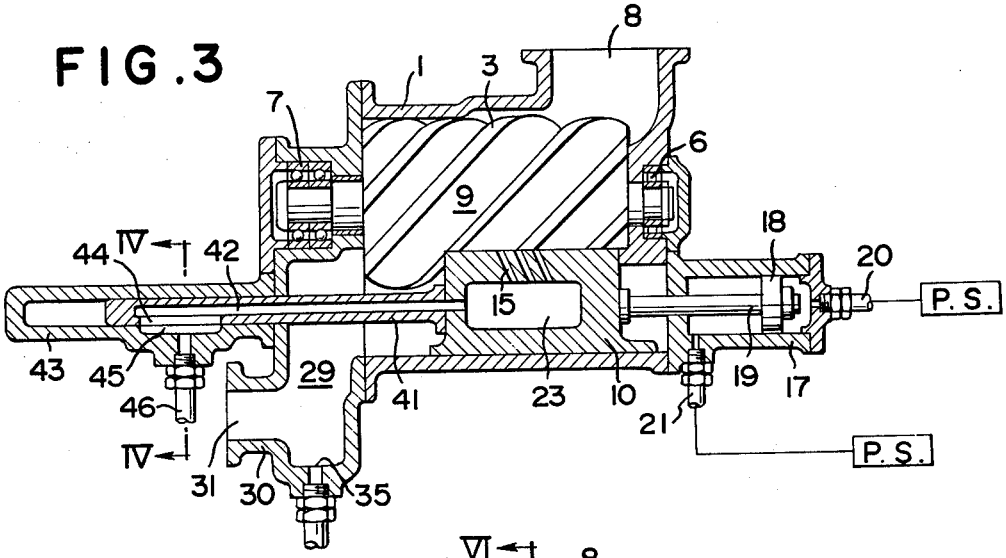
FIG. 3 is a partially cut-away, longitudinal sectional view illustrating the second embodiment of this invention.

FIGS. 3 and 4 illustrate the second embodiment of this invention, the structure of which is substantially identical with that of the first embodiment shown in FIGS. 1 and 2 except for the following points.

In the second embodiment, a liquid-introducing tube 41 extending in the axial direction of the rotors is mounted on the adjusting valve 10 on the side opposite to the side where the rod 19 is attached. The top end 42 of the tube 41 runs through the part 30 of the casing and is slidably inserted in a cylinder 43 disposed on the outside of the part 30 of the casing coaxially with the top end 42 of the tube 41.

A slot 44 is formed at the lower part of the top end portion 42 of the liquid-introducing tube 41 and a slot 45 is formed in the interior of the cylinder 43 at the lower portion thereof. The slot 45 is connected to the tank 28 through a liquid-introducing inlet 46 in the same way as in the first embodiment shown in FIG. 1. The slot 44 is connected to the hollow portion 23 of the adjusting valve 10 through the liquid-introducing tube 41.

FIG. 3 illustrates the state in full load operation. where the opening of the slot 45 of the cylinder 43 overlaps the opening of the slot 44 of the liquid-introducing tube 41 along the entire length, and the full amount of the liquid is fed to the compression chambers 9. When the volume of the sucked compressed gas is adjusted, the adjusting valve 10 is moved to the left in FIG. 3 in the same way as in the first embodiment, and hence, the tube 41 is also moved to the left. Accordingly, the area of passage through the slots 44 and 45 is reduced and the amount of the liquid supplied to the compression chambers is appropriately controlled. As in the case of the first embodiment, the width of the slots 44 and 45 is variable in the longitudinal direction so that the amount of the liquid is appropriately controlled in conformity with the change in the volume of the sucked gas. The adjustment apparatus of this kind can be connected to an unloader of the suction-closing type. In case it is necessary to change the once determined curve of the relation between the volume of the sucked and compressed gas and the amount of the injected liquid within the above-mentioned allowable range, a desired curve can be obtained by rotating the cylinder 43 around the axis or moving it in the axial direction to change the overlapping state between the slots 44 and 45.

Figure 5:
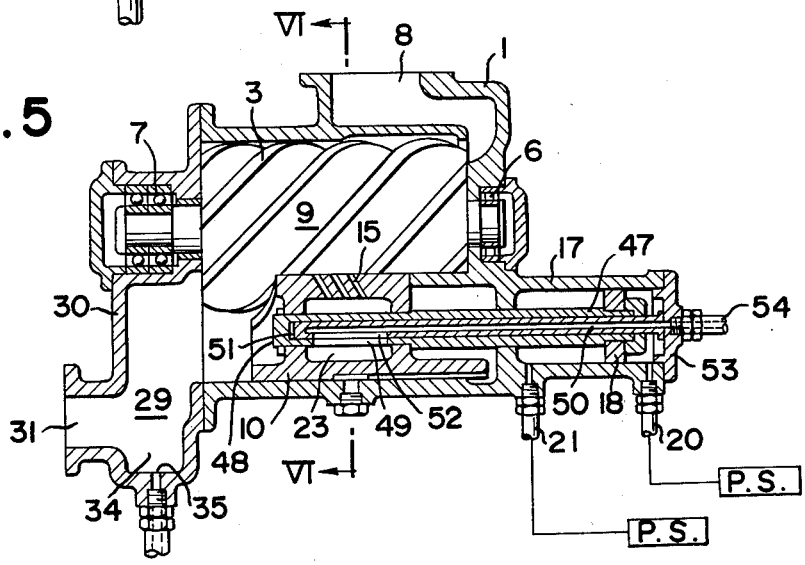
FIG. 5 is a partially cut-away, longitudinal sectional view illustrating the third embodiment of this invention.
Figure 6:
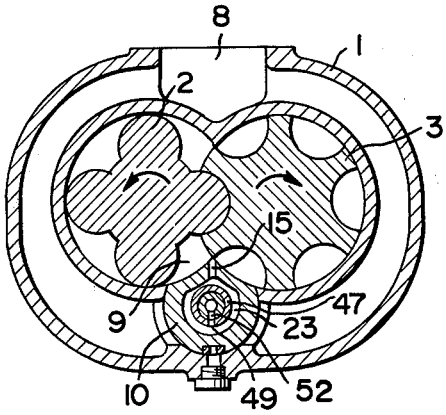
FIG. 6 is a view illustrating a section of the third embodiment taken along the line VI—VI in FIG. 5.

FIGS. 5 and 6 illustrate the third embodiment of this invention, the structure of which is substantially the same as that of the first embodiment shown in FIGS. 1 and 2 except for the following points.

One end of a hollow rod 47 penetrating the adjusting valve 10 is attached to the valve 10, and the other end of the hollow rod 47 is attached to the piston 18. One end 48 of the rod 47 attached to the adjusting valve 10 is blind, and the rod 47 has a slot 49 in the lower portion which is located in the hollow portion 23 of the adjusting valve 10, and this slot 49 is communicated with the hollow portion 23 of the valve 10.

A liquid-introducing tube 50 is slidably inserted in the hollow rod 47, and one end 51 of the tube 50 on the side of the adjusting valve 10 is blind, and a slot 52 is formed in the lower portion of this end 51. The slot 52 is communicated with the slot 49. The other end of the liquid-introducing tube 50 is attached to the outer end 53 of the cylinder 17 through the hollow rod 47 and is connected to a liquid-introducing inlet 54. This liquid-introducing inlet 54 is connected to the tank 28 in the same way as in the first embodiment shown in FIG. 1.

When the compressor is operated under full load, the opening of the slot 49 of the hollow rod 47 coincides with the opening of the slot 52 of the liquid-introducing tube 50. Accordingly, the cooling, lubricating and sealing liquid is introduced from the introduction inlet 54, passed through the liquid-introducing tube 50, introduced into the hollow portion 23 of the adjusting valve 10 and injected from the injection opening 15 into the compression chambers 9.

FIG. 5 illustrates the state of full load operation. In this state, the slots 52 and 49 overlap each other along the entire length and their openings coincide with each other completely, so that the full amount of the liquid is fed into the compression chambers 9. When it is desired to change the volume of the sucked gas, a hydraulic or air pressure introduced from the inlets 20 and 21 of the operation cylinder 17 is changed to move the piston 18 to the left in FIG. 5, and accordingly, the adjusting valve 10 is moved to the left through the rod 47 to reduce the volume of the sucked gas.

By the movement of the rod 47, the overlapping area of the slots 49 and 52 is narrowed down to appropriately control the amount of the liquid injected into the compression chambers.

As in the first and second embodiments, the width of the slots 49 and 52 is variable in the longitudinal direction so that the amount of the liquid is adjusted appropriately in conformity with the change of the volume of the sucked gas.

Figure 7:
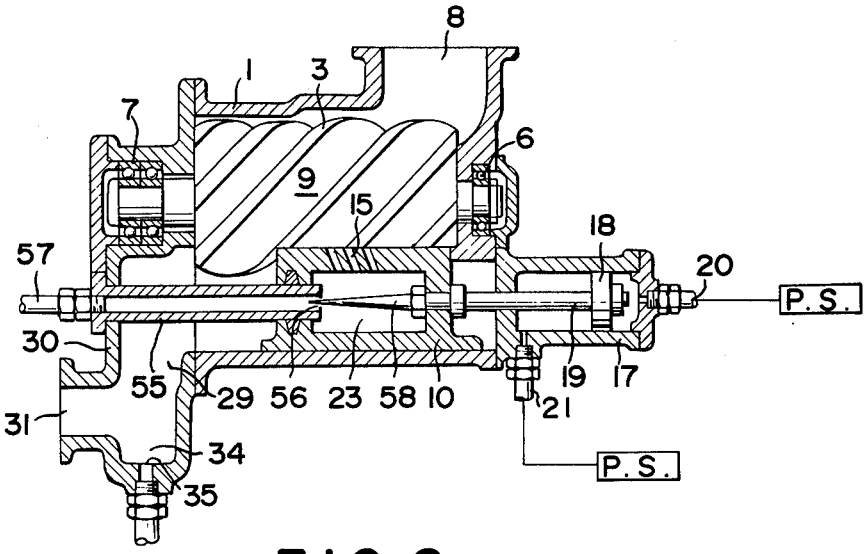
FIG. 7 is a partially cut-away, longitudinal sectional view illustrating the fourth embodiment of this invention.

FIG. 7 illustrates the fourth embodiment of this invention. In FIG. 7, one end 56 of a liquid-introducing tube 55 is slidably inserted in the axial direction into the adjusting valve 10 on the side opposite to the side where the rod 19 is attached, and the other end of the liquid-introducing tube 55 penetrates and is fixed to the part 30 of the casing, and is connected to the tank 28 in the same way as in the first embodiment shown in FIG. 1.

An adjusting needle 58 is disposed in the hollow portion 23 of the adjusting valve 10 so that it can move to and fro in the axial direction in the tube opening of the end 56 of the liquid-introducing tube 54.

In case the adjusting valve 10 moves to change the volume of the sucked gas, the above mentioned adjusting needle 58 is moved to and fro in the opening of the end 56 of the liquid-introducing tube 55, whereby the area of passage for the liquid is controlled and the amount of the liquid fed into the compression chamber is adjusted.

The shape of the adjusting needle 58 is designed so that the curve of the relation between the amount of liquid and the volume of gas is within the allowable range shown in the graph of FIG. 8.

In all of the embodiments described above, the liquid collected in the liquid reservoir 34 of the discharge chamber 29 is continuously removed by the pump 36 exclusively provided for recovery of the liquid, and the liquid is then passed to the compressed gas and liquid tank 28 through the pipe 37.

Thus, the cooling, lubricating and sealing liquid collected in the discharge chamber 29 is always discharged therefrom in the above-mentioned manner, whereby generation of a back pressure by the liquid is prevented to avoid wasteful consumption of power, and to prevent troubles and noises in the compressor.

What is claimed is:

1. A rotary compressor of the liquid-cooled type comprising a casing, male and female rotors contained in said casing, means for feeding a cooling, lubricating and sealing liquid into gas compression chambers defined by said casing and rotors, said casing having a discharge chamber connected to said gas compression chambers, a tank for a compressed gas and a cooling, lubricating and sealing liquid which is connected to said discharge chamber and said liquid feed means, an adjusting valve for adjusting the intake volume of a gas to be compressed by shifting the sucking and shutting position in said compression chambers, said valve having a hollow main body and being capable of sliding in the axial direction of said rotors, and means for sliding said adjusting valve in said axial direction being provided in said casing, a first slot connected to said liquid feed means formed in said casing on a sliding surface for said main body of the adjusting valve, a second slot connected to said first slot formed in said main body of the adjusting valve, and openings for injecting the liquid fed through a liquid passage defined by the overlap of said two slots into said compression chambers formed in said main body of said adjusting valve, the cross-sectional area of said overlapped liquid passage being changed by the sliding of said adjusting valve so that the volume of the gas is adjusteed while the optimum amount of said liquid is injected into said compression chambers in conformity with the volume of said gas.

2. A rotary compressor of the liquid-cooled type as set forth in claim 1, wherein said discharge chamber has a liquid reservoir in the bottom thereof and a gas discharge opening in the side wall thereof and is of suitable shape and sufficient volume to separate the liquid from the gas, and an opening for taking-out the liquid in said liquid reservoir is provided at a lower level than said gas discharge opening and at the lowest point in said liquid reservoir.

3. A rotary compressor of the liquid-cooled type comprising a casing, male and female rotors contained in said casing, means for feeding a cooling, lubricating and sealing liquid into gas compression chambers defined by said casing and rotors, said casing having a discharge chamber connected to said gas compression chambers, a tank for a compressed gas and a cooling, lubricating and sealing liquid which is connected to said discharge chamber and said liquid feed means, means for adjusting the intake volume of a gas to be compressed by shifting the sucking and shutting position in said compression chambers and means for adjusting the amount of the cooling, lubricating and sealing liquid to be injected into said compression chambers in conformity with the adjustment made by said gas volume-adjusting means, said liquid amount-adjusting means being interlocked with said gas volume-adjusting means, the adjustment by said liquid amount-adjusting means being made so that the relation represented by the following formula is established between the volume of the gas and the amount of a cooling, lubricating and sealing liquid to be injected:

$$103 - (330/G + 10) \geqq L \geqq (4/5)G + 20$$

wherein G stands for a relative value of the volume of the gas adjusted by said gas volume-adjusting means, which is determined based on the supposition that the volulme of the compressed gas in full load operation is 100, and L stands for a relative value of the amount of the cooling, lubricating and sealing liquid to be injected, adjusted by said liquid amount-adjusting means, which is determined based on the supposition that the amount of the liquid to be injected in full load operation is 100, said gas volume-adjusting means comprising an adjusting valve for shutting said compression chambers having a hollow main body and being capable of sliding in the axial direction of said rotors, and means for sliding said adjusting valve in said axial direction being provided in said casing, and said liquid amount-adjusting means comprising a first slot connected to said liquid feed means formed in said casing on a sliding surface for said main body of the adjusting valve, a second slot connected to said first slot formed in said main body of the adjusting valve, and openings for injecting the liquid fed through a liquid passage defined by the overlap of said two slots into said compression chambers formed in said main body of said adjusting valve, the cross-sectional area of said overlapped liquid passage being changed by the sliding of said adjusting valve so that the volume of the gas is adjusted while the optimum amount of said liquid is injected into said compression chambers in conformity with the volume of said gas.

4. A rotary compressor of the liquid-cooled type as set forth in claim 3 wherein said discharge chamber has a liquid reservoir in the bottom thereof and a gas discharge opening on the side wall thereof and is of suitable shape and sufficient volume to separate the liquid from the gas and an opening for taking-out the liquid in said liquid reservoir is provided at a lower level than said gas discharge opening and at the lowest point in said liquid reservoir.

* * * * *